United States Patent [19]

Yan

[11] 4,334,976

[45] Jun. 15, 1982

[54] UPGRADING OF RESIDUAL OIL

[75] Inventor: Tsoung Y. Yan, Philadelphia, Pa.

[73] Assignee: Mobil Oil Corporation, New York, N.Y.

[21] Appl. No.: 224,778

[22] Filed: Jan. 13, 1981

Related U.S. Application Data

[63] Continuation-in-part of Ser. No. 186,927, Sep. 12, 1980.

[51] Int. Cl.[3] ..... C10G 1/00; C10G 45/00; C10G 17/00

[52] U.S. Cl. ..... 208/8 LE; 208/211; 208/251 H; 208/97

[58] Field of Search ..... 208/8 LE, 211, 251 H

[56] References Cited

U.S. PATENT DOCUMENTS

| | | | |
|---|---|---|---|
| 3,396,099 | 8/1968 | Glinko | 208/8 LE X |
| 3,696,027 | 10/1972 | Bridge | 208/210 |
| 3,730,879 | 5/1973 | Christman et al. | 208/210 |
| 3,775,303 | 11/1973 | McKinney et al. | 208/210 |
| 3,876,530 | 4/1975 | Frayer et al. | 208/210 |
| 3,882,049 | 5/1975 | Bertolacini et al. | 208/210 X |
| 3,897,329 | 7/1975 | Franz et al. | 208/210 |
| 3,901,792 | 8/1975 | Wolk et al. | 208/210 |
| 3,905,893 | 9/1975 | Christman et al. | 208/210 |
| 3,964,995 | 6/1976 | Wolk et al. | 208/210 |
| 3,985,643 | 10/1976 | Milstein | 208/210 |
| 4,016,067 | 4/1977 | Fischer et al. | 208/210 X |
| 4,052,292 | 10/1977 | Espenscheid et al. | 208/8 LE |
| 4,075,079 | 2/1978 | Lang | 208/8 LE |
| 4,079,005 | 3/1978 | Tan et al. | 208/8 LE X |

*Primary Examiner*—Delbert E. Gantz
*Assistant Examiner*—William G. Wright
*Attorney, Agent, or Firm*—Charles A. Huggett; Michael G. Gilman; Charles J. Speciale

[57] ABSTRACT

This invention provides a process which involves visbreaking of a heavy hydrocarbon oil in the presence of a suspension of coal particles of 50–2000 micron size.

The presence of the fine coal solids permits severe visbreaking conditions which increases the yield of fuel range distillate products. Coke deposition occurs on the surfaces of the coal particles rather than on the surfaces of the heater chambers.

The coal particle surfaces also serve to catalyze demetallation of the heavy oil feedstock, and to adsorb demetallation deposits.

16 Claims, 1 Drawing Figure

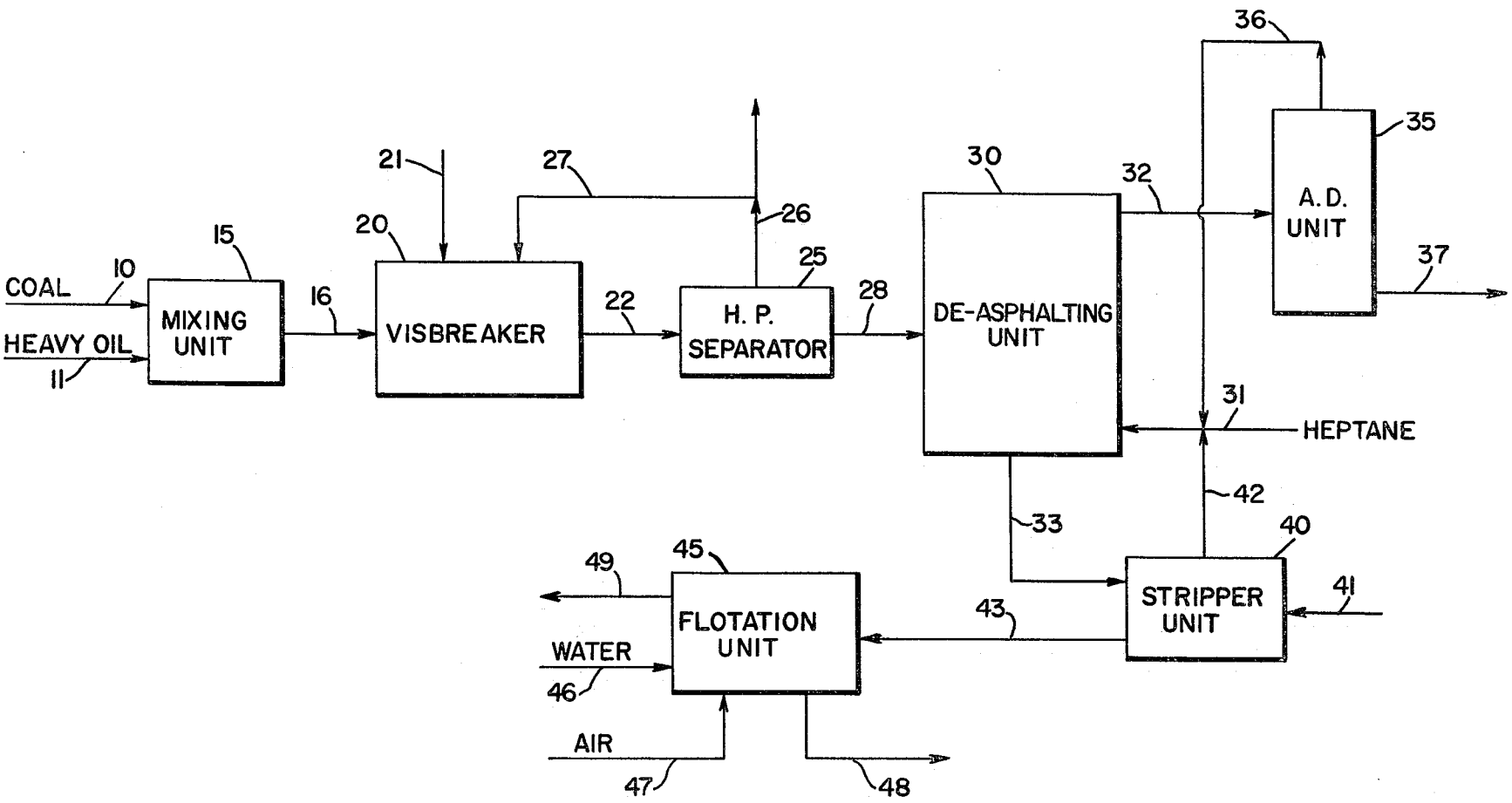
COAL
HEAVY OIL
MIXING UNIT
VISBREAKER
H. P. SEPARATOR
DE-ASPHALTING UNIT
A.D. UNIT
HEPTANE
STRIPPER UNIT
FLOTATION UNIT
WATER
AIR
10
11
15
16
20
21
22
25
26
27
28
30
31
32
33
35
36
37
40
41
42
43
45
46
47
48
49

UPGRADING OF RESIDUAL OIL

This patent application is a continuation-in-part of patent application Ser. No. 186,927, filed Sept. 12, 1980.

BACKGROUND OF THE INVENTION

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes present.

The high metals content of the residual fractions generally preclude their effective use as chargestocks for subsequent catalytic processing such as catalytic cracking and hydrocracking, because the metal contaminants deposit on the special catalysts for these processes and cause the formation of inordinate amounts of coke, dry gas and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°–1100° F. temperature and a pressure of 1–10 atmospheres. The economic value of the coke byproduct is determined by its quality. particularly its sulfur and metals content. Excessively high levels of these contaminants makes the coke useful only as low-valued fuel. In contrast, cokes of low metals content, for example up to about 100 ppm (parts per million by weight) of nickel and vanadium, and containing less than about 2 weight percent sulfur may be used in high-valued metallurgical, electrical, and mechanical applications.

Presently, catalytic cracking is generally accomplished by utilizing hydrocarbon chargestocks lighter than residual fractions which usually have an API gravity less than 20. Typical cracking chargestocks are coker and/or crude unit gas oils, vacuum tower overhead, and the like, the feedstock having an API gravity from about 15 to about 45. Since these cracking chargestocks are distillates, they do not contain significant proportions of the large molecules in which the metals are concentrated. Such cracking is commonly carried out in a reactor operated at a temperature of about 800°–1500° F., a pressure of about 1–5 atmospheres, and a space velocity of about 1–1000 WHSV.

The amount of metals present in a given hydrocarbon stream is often expressed as a chargestock's "metals factor". This factor is equal to the sum of the metals concentrations, in parts per million, of iron and vanadium plus ten times the concentration of nickel and copper in parts per million, and is expressed in equation form as follows:

$$F_m = Fe + V + 10(Ni + Cu)$$

Conventionally, a chargestock having a metals factor of 2.5 or less is considered particularly suitable for catalytic cracking. Nonetheless, streams with a metals factor of 2.5–25, or even 2.5–50, may be used to blend with or as all of the feedstock to a catalytic cracker, since chargestocks with metals factors greater than 2.5 in some circumstances may be used to advantage, for instance with the newer fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80 percent of the metals and preferably at least 90 percent needs to be removed to produce fractions (having a metals factor of about 2.5–50) suitable for cracking chargestocks.

The economic and environmental factors relating to upgrading of petroleum residual oils and other heavy hydrocarbon feedstocks have encouraged efforts to provide improved processing technology, as exemplified by the disclosures of various United States patents which include U.S. Pat. Nos. 3,696,027; 3,730,879; 3,775,303; 3,876,530; 3,882,049; 3,897,329; 3,905,893; 3,901,792; 3,964,995; 3,985,643; 4,016,067, and the like.

Accordingly, it is a main object of the present invention to provide an improved method for upgrading heavy hydrocarbon oils for use as liquid fuels or as demetallized feedstocks for refinery cracking operations. Other objects and advantages of the present invention shall become apparent from the accompanying description and illustrated data.

DESCRIPTION OF THE INVENTION

One or more objects of the present invention are accomplished by the provision of a process for heavy hydrocarbon oil demetallation which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; and (3) distilling the said oil fraction to remove the deasphalting solvent and yield a demetallized liquid hydrocarbon product.

In a more particular embodiment, this invention provides a process for heavy hydrocarbon oil demetallation and coal liquefaction which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; (3) distilling the said oil fraction to remove the deasphalting solvent and yield a demetallized liquid hydrocarbon product; and (4) treating the said asphaltic solids fraction under flotation conditions in an aqueous medium to separate a float phase of organic solids product from a sink phase of inorganic ash.

The term "heavy hydrocarbon oil" is meant to include petroleum oil residua and tar sand bitumen feedstocks, in which mixtures at least 75 weight percent of the constituents have a boiling point above about 700° F.

Typically, a heavy hydrocarbon oil suitable for treatment in accordance with the present invention has a metals content of at least 80 ppm, and a Conradson Carbon Residue content of at least 10 weight percent.

The coal component of the invention process can be any of a variety of carbonaceous materials which include bituminous and sub-bituminous types of coal, lignite, peat, and the like. The nominal analysis of typical coals are as follows:

| | |
|---|---|
| Sub-Bituminous | |
| Sulfur | 0.21% |
| Nitrogen | 0.88 |
| Oxygen | 15.60 |
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for crushing and pulverizing coarse coal in the preparation of the particulate coal feed for the visbreaking step (1) of the process. The crushing and grinding of the coal can be accomplished either in a dry state or in the presence of a liquid such as the heavy hydrocarbon oil being employed in the practice of the invention process. The average particle size of the coal feed is preferably below about 0.25 inches, such as finely divided bituminous coal which has a particle size of less than about 3 mesh (U.S. Sieve Series).

Visbreaking Conditions

The oil and coal are slurried in a mixing zone and pumped through a visbreaking reaction zone. The weight ratio of heavy hydrocarbon oil to coal is in the range between about 1.5–10:1.

The step (1) visbreaking heat treatment is conducted at a temperature between about 800°–950° F., and at a weight hourly space velocity between about 1–100.

It is preferred that the visbreaking heat treatment is conducted under a hydrogen partial pressure between about 50–2000 psi. Addition of steam to the level of about 0.1–5 weight percent of the combined charge stock is also advantageous.

Demetallation occurs at the incipient temperature of coking for the heavy hydrocarbon oil, i.e., a temperature above about 800° F. The demetallation proceeds rapidly, particularly because the oil is in contact with solid particles. At 800° F. and above thermal conversion of the heavy hydrocarbon oil yields light distillates. Any coke which is coproduced effectively becomes incorporated in the surrounding matrix of coal and ash particles.

Simultaneously, coal depolymerization occurs with the production of gas and liquid constituents. The heavy hydrocarbon oil is a polycyclic aromatic hydrocarbon component which can function as a solvent to convert at least a portion of the coal to liquid constituents.

The visbreaker effluent is passed through a high pressure separator to vent the light end constituents. If hydrogen gas is present, the gas mixture is at least partially recycled to the visbreaking zone. Alternatively, the gas mixture can be fractionated to recover the hydrogen gas for recycle.

Solvent Deasphalting Conditions

The degassed visbreaker effluent from step (1) is subjected to deasphalting fractionation with a light solvent. It is preferred that the deasphalting zone is a liquid-liquid countercurrent contacting system.

Suitable deasphalting solvents include liquefied normally gaseous hydrocarbons such as ethane, ethylene, propane, propylene, n-butane, isobutane, n-butylene, isobutylene, pentane, and isopentane; cyclohexane; hexane; heptane; decane; octane; nonane, decalin; and mixtures thereof. The yield of liquid products extracted in the deasphalting operation can be increased if a light $C_6$–$C_{16}$ aromatic solvent is employed, e.g., benzene, toluene, xylene, mesitylene, naphthalene, and the like. In general, the deasphalting solvent of choice is a liquid hydrocarbon containing between about 3–12 carbon atoms.

The weight ratio of deasphalting solvent to visbroken admixture in step (2) normally will be in the range between about 0.5–5:1.

The deasphalting treatment in step (2) preferably is conducted at a temperature between about 100°–500° F. and at a sufficient pressure to maintain the deasphalting solvent in liquid form, and for a period between about 0.1–1.5 hours.

The liquid solvent extract phase and the precipitated asphaltic solids are withdrawn separately from the deasphalting zone. The solvent-oil effluent is charged to an atmospheric distillation tower to strip off the deasphalting solvent. The distillation bottom fraction is a demetallized liquid hydrocarbon product. The metals content of the liquid hydrocarbon product is less than about 50 ppm.

The quantity yield of the demetallized liquid hydrocarbon product on the average constitutes between about 45–90 weight percent of the total weight of heavy hydrocarbon oil and coal (m.a.f.) fed into the processing system.

The precipitated asphaltic solids fraction which is recovered tends to be saturated with adsorbed solvent and oil. Preferably the said asphaltic solids fraction is subjected to washing with light solvent or steam stripping to remove the adsorbed liquid and provide residual solids in a substantially dry form.

Ash Separation

Preferably, the stripped asphaltic solids recovered in the manner described above are in the form of a fine powder. In some cases mechanical crushing may be required, depending on the nature of the coal and the processing conditions.

The powdered asphaltic solids are treated under flotation conditions in an aqueous medium to yield a float phase of organic solids product which has been separated from a sink phase of inorganic ash.

The flotation of the organic solids product is facilitated by air-frothing, particularly in combination with flotation aids such as ionic and nonionic surfactants, and the like.

The organic solids product on the average constitutes between about 10–50 weight percent of the total weight of heavy hydrocarbon oil and coal (m.a.f.) fed into the processing system. The organic solids product usually contains between about 5–30 of char and unreacted coal.

Illustrative of the invention process, the drawing is a schematic representation of visbreaking, deasphalting and flotation units in series for coprocessing of heavy hydrocarbon oil and coal, with recovery and recycle of deasphalting solvent to the deasphalting unit.

Referring to the drawing, coal is charged through line 10 and heavy hydrocarbon oil is charged through line 11 into Mixing Unit 15 where they are admixed to form a slurry.

The coal is a High Volatile A bituminous stock which has been ground to a particle size of about 50 mesh. The coal has the following elemental analysis:

Sulfur: 1.33%
Nitrogen: 1.63
Oxygen: 7.79
Carbon: 80.88
Hydrogen: 5.33
Ash: 2.77

The heavy hydrocarbon oil is an Arabian light vacuum residual fraction which has the following analysis:

API, gravity: 8.3
H, wt %: 10.67
S, wt %: 3.93
N, wt %: 0.28
CCR, wt %: 16.13
V, ppm: 68
Ni, ppm: 17
MW: 810

The oil-coal slurry admixture is withdrawn from Mixing Unit 15 and pumped through a preheating unit and passed into Visbreaker Unit 20 via line 16. The weight ratio of oil to coal is about 2:1, and the weight hourly space velocity of the oil-coal is about 20.

Hydrogen is entered into Visbreaker Unit 20 through line 21 to provide a hydrogen partial pressure of about 600 psig in the visbreaking zone at a temperature of about 825°-850° F.

The visbreaker effluent is passed through line 22 to High Pressure Separator 25, where a gaseous fraction is vented through line 26. A portion of the hydrogen-rich gas is recycled to Visbreaker Unit 20 via line 27.

The degassed visbreaker effluent is transferred through line 28 to the top section of Deasphalting Unit 30, where it flows downward in countercurrent contact with heptane which is fed into Deasphalting Unit 30 through line 31.

The weight ratio of heptane to visbroken admixture in the deasphalting zone is maintained at about 3:1, with the temperature being at about 300° F. and the pressure at about 600 psig. The liquid-liquid contact time in the deasphalting zone is about 10 minutes.

A liquid oil fraction of heptane-soluble hydrocarbon constituents exits from the top of Deasphalting Unit 30 and is passed through line 32 to Atmospheric Distillation Unit 35. Heptane is recovered from the distillation column and recycled via line 36 to Deasphalting Unit 30.

Demetallized liquid hydrocarbon product is withdrawn from the processing system via line 37. The liquid hydrocarbon product has a metals content of about 20 ppm, and a CCR weight percent of about 10. The yield of demetallized liquid hydrocarbon product constitutes about 65 weight percent of the total weight of heavy hydrocarbon oil and coal (m.a.f.) fed into the processing system.

Precipitated asphaltic solids are withdrawn from Deasphalting Unit 30 through line 33 and entered into Stripper Unit 40. The asphaltic solids contain small quantities of unreacted coal and inorganic ash.

Steam is fed into Stripper Unit 40 through line 41 to remove residual heptane and oil from the asphaltic solids. The stripped liquid hydrocarbons are recycled through line 42 to Deasphalting Unit 30.

The stripped asphaltic solids are removed from Stripper Unit 40, mechanically crushed to a fine powder and transferred via line 43 to Flotation Unit 45.

Water is supplied to Flotation Unit 45 through line 46, and air is supplied through line 47. A small quantity of No. 2 oil is added to the aqueous medium in Flotation Unit 45 to facilitate the flotation of organic solids product.

An inorganic ash sink phase is withdrawn from Flotation Unit 45 through line 48 and discarded. An organic solids float phase is removed from the processing system via line 49.

The organic solids product constitutes about 30 percent of the total weight percent of heavy hydrocarbon oil and coal (m.a.f.) fed into the processing system. The organic solids product contains less than about 10 weight percent of char and unreacted coal.

Process Improvement

In another of its embodiments, the present invention provides an improved process for heavy hydrocarbon oil conversion which comprises (1) heating an admixture of heavy hydrocarbon oil and particulate coal under visbreaking conditions, wherein the average particle size of the coal is less than about 2000 microns; (2) cooling the heat-treated admixture in a settling zone to a temperature in the range between about 400°-700° F. to provide an oil fraction and a fraction of asphaltene flocculated fine solids; and (3) separating and recovering the oil fraction and the solids fraction.

In a typical operation, the heavy hydrocarbon oil feedstock is crude oil or a distillation residuum of crude oil (e.g., atmospheric or vacuum), the particular coal is bituminous coal, the average particle size of the coal is in the range between about 20-2000 microns, and the weight ratio of heavy hydrocarbon oil to coal in the step (1) admixture is in the range between about 1.5-20:1.

Preferably, the step (1) heat treatment is conducted at a temperature between about 800°-950° F. and a pressure between about 0-2000 psi, and at a weight hourly space velocity between about 0.1-100.

It is particularly advantageous to conduct the step (1) heat treatment in the presence of a hydrogen partial pressure between about 50-2000 psi to increase demetallation of the feedstock and to suppress formation of coke. The presence of hydrogen also functions to increase liquefaction of the particulate coal phase, with a resultant increase in the yield of liquid hydrocarbon product.

When hydrogen is employed as a component in the visbreaking zone, the heat-treated effluent is passed through a high pressure separator to vent the hydrogen and other light end constituents. The hydrogen gas is recovered and recycled in the process.

As a further variation, the step (1) heat treatment can be conducted in the presence of an inert gas to aid in the control of the flow dynamics of the system. Illustrative of inert gases are steam, helium, nitrogen, methane, ethane, propane, butane, and the like. An inert gas such as steam has the additional advantage of reducing the quantity of coke deposition.

With respect to step (2) of the process, in a typical operation the step (2) settling zone is maintained at a temperature between about 450°-650° F. and a pressure between about 0-2000 psi for a period between about 0.1-5 hours.

It is also advantageous to include a deasphalting solvent in the step (2) settling zone to promote the settling of asphaltene flocculated fine solids. Illustrative of suitable deasphalting solvents are those previously described liquid hydrocarbons containing between about 3–12 carbon atoms.

An important aspect of the step (2) settling phase is the precipitation of asphaltenes from the heat-treated effluent, and the concomitant asphaltene flocculation of the fine solids in the settling zone. The flocculation of fine solids serves to facilitate the step (3) separation and recovery of the oil fraction and solids fraction.

The said recovered oil fraction (i.e., the overflow stream) usually is sufficiently demetallized to qualify as chargestock to a hydrotreating unit for the production of low sulfur distillate product. Alternatively, the recovered oil fraction can be subjected to distillation to provide gas oil distillate and residual tar bottoms. The gas oil distillate is suitable as feed to a fluidized catalytic cracking unit, or as feed to a hydrotreating unit. The tar bottoms fraction can be employed directly as heavy residual fuel, or it can be reserved as chargestock for the production of asphalt or coke.

The solids fraction (i.e., the underflow stream) recovered in step (3) of the process is constituted essentially of flocculated solids material, but normally will include asphaltenes and some adsorbed oil. The said solids fraction can be recycled to the step (1) heat-treating zone. The high temperature of the heat-treating zone functions to deflocculate the asphaltene flocculated solids. The said solids provide the particle surfaces required for metal and coke deposition. The presence of the particle surfaces has the advantage of both catalyzing and adsorbing metal deposition, and has the further advantage of adsorbing coke deposits which otherwise would collect in the tubes of a heating unit.

Alternatively, in another embodiment either a portion or all of the solids fraction recovered in step (3) of the process can be diverted from the main train of the system and reserved for use as a coal-oil solid fuel composition. The metals content of the said coal-oil solid fuel composition may be sufficiently high to warrant metals recovery from the ash of the solid fuel after combustion.

In a further embodiment, either a portion or all of the solids fraction recovered in step (3) of the process can be diverted from the main train of the system and reserved as chargestock for other conversion procedures. For example, the said solids fraction can be extracted with a solvent (e.g., furfural) to yield an extract phase and a fine solids phase. The said solids can be employed as a solid fuel, or recycled to step (1) of the main process. The extract phase can be fractioned to recover the solvent, and to provide a residual asphaltic material.

The advantages of the above described invention process improvement are manifold. The control of fine solids particle size in the series of zones is a significant factor for purposes of optimization of the process results.

In the visbreaking zone, the coal particles are small enough to fluidize readily, while functioning as nuclei for coke deposition and as sites for demetallation residues.

The presence of the fluidized particulate coal permits a higher level of visbreaking severity in step (1), without coke plugging of the heater unit chambers and without destabilizing of the liquid hydrocarbon products. There is achieved a greater degree of viscosity reduction, boiling range lowering, and demetallation and desulfurization of the heavy oil feedstock.

In the settling zone of the process, the cooling of the heat-treated effluent causes precipitation of asphaltenes from the effluent medium, and the asphaltenes then contact the dispersed fine solids in the effluent medium and cause them to flocculate to a degree which depends on the temperature and the residence time of the solids in the settling zone. In step (3), the flocculated particles because of their increased size and weight can be separated more readily from the visbroken oil phase.

The main objectives of the process improvement then are to maximize the yield of fuel range distillates, and to minimize the production of coke.

The yield of fuel range distillates is further enhanced by conversion products which derive from liquefaction of the coal solids, particularly in the presence of hydrogen gas.

The degree and kind of coal liquefaction can be controlled as desired by such parameters as temperature, residence time, and particle size and weight ratio of the coal component in the visbreaking zone of the process.

The following example is further illustrative of the present invention. The reactants and other specific ingredients are presented as being typical, and various modifications can be derived in view of the foregoing disclosure within the scope of the invention.

EXAMPLE

This Example illustrates the visbreaking heat treatment of admixtures of a heavy hydrocarbon oil and particulate coal.

The heavy hydrocarbon oil is Joliet vacuum residue and the coal is particulate Illinois No. 6 coal (particle size less than about 2000 microns).

The visbreaker unit is a ⅜ inch O.D. × one foot stainless steel reactor equipped with feeding, heating, pressure control, gas sampling and product recovery means.

Tables I and II summarize the results of visbreaking heat treatment at 850° F., 400 psig and 12 LHSV, and Table III summarizes the results obtained when the heat treatment is conducted at 870° F., 400 psig and 12 LHSV.

The data in Tables I and II demonstrate the degree of metals removal from a heavy hydrocarbon oil achieved with a process in accordance with the present invention. The results in Table III indicate that heat treatment at a higher temperature (e.g., 870° F.) increases the metals removal from a high metals content hydrocarbon oil such as a vacuum residuum.

TABLE I

| | | | | | | |
|---|---|---|---|---|---|---|
| Coal, % Wt | 0 | 5 | 10 | 20 | 30 | 100 |
| Joliet Residue, % Wt | 100 | 95 | 90 | 80 | 70 | 0 |
| Properties | | | | | | |
| Gravity, °API, 60/60° F. | 6.1 | — | — | — | — | — |
| Conradson Carbon Residue (CCR), % Wt | 19 | — | — | — | — | — |
| Asphaltenes, % Wt | 9.2 | — | — | — | — | — |
| Viscosity, cS at, 130° F. | 271,715 | — | — | — | — | — |
| 212° F. | 2,342 | — | — | — | — | — |
| Nickel, ppm* | 53 | 54 | 54 | 55 | 57 | 65 |
| Vanadium, ppm* | 250 | 238 | 227 | 205 | 181 | <20 |
| Ash, % Wt | <0.1 | — | — | — | — | 10 |
| Liquid Product | | | | | | |
| Gravity, °API, 60/60° F. | 5.7 | 5.7 | 5.7 | 6.2 | 7.6 | — |
| Asphaltenes, % Wt | 15.2 | — | — | — | — | — |
| CCR, % Wt | 19 | — | 19 | 19 | 18 | — |
| Viscosity, cS at 130° F. | 622 | — | — | — | — | — |
| 212° F. | 112 | — | — | — | — | — |
| Nickel, ppm | 53 | 50 | 42 | 34 | 32 | — |
| Vanadium, ppm | 243 | 216 | 181 | 146 | 131 | — |

TABLE I-continued

| | | | | | | |
|---|---|---|---|---|---|---|
| Solid Product | | | | | | |
| Nickel, ppm | — | — | 135 | 130 | 80 | 65 |
| Vanadium, ppm | — | — | 495 | 535 | 225 | <25 |

*Calculated for the mixtures.

TABLE II

| | | | | | |
|---|---|---|---|---|---|
| Coal, % Wt | 0 | 5 | 10 | 20 | 30 |
| Residue, Wt % | 11 | 95 | 90 | 80 | 70 |
| Yield, % Wt | | | | | |
| Gas | 1 | 2.8 | 3.4 | 3.9 | 4.3 |
| Liquid | 99 | 96.1 | 92.5 | 86.6 | 79.5 |
| Solid | 0 | 1.1 | 4.1 | 9.5 | 16.2 |
| Total Coal Conversion, % | — | 78 | 59 | 53 | 46 |
| % of Coal Solubilized | — | 41 | 34 | 37 | 34 |
| % of Coal Converted to Gas | — | 37 | 25 | 16 | 12 |
| % Demetallation | | | | | |
| Nickel | 0 | 6 | 21 | 36 | 40 |
| Vanadium | 0 | 11 | 26 | 40 | 46 |

TABLE III

| | | |
|---|---|---|
| Coal, % Wt | 20 | 30 |
| Residue, % Wt | 80 | 70 |
| Liquid Product | | |
| Gravity, °API | 5.7 | 5.7 |
| Asphaltenes, % Wt | — | 17 |
| CCR, % Wt | 19 | 19 |
| Nickel, ppm (%)* | 29 (45) | 25 (53) |
| Vanadium, ppm | 120 (52) | 67 (73) |
| Solid Product | | |
| Nickel, ppm | — | 110 |
| Vanadium, ppm | — | 360 |

*Data in parentheses represent extent of demetallation of processed Joliet vacuum residue.

What is claimed is:

1. A process for heavy hydrocarbon oil conversion which comprises (1) heating an admixture of heavy hydrocarbon oil and particulate coal under visbreaking conditions, wherein the average particle size of the coal is less than about 2000 microns; (2) cooling the heat-treated admixture in a settling zone to a temperature in the range between about 400°–700° F. to provide an oil fraction and a fraction of asphaltene flocculated fine solids; and (3) separating and recovering the oil fraction and the solids fraction.

2. A process in accordance with claim 1 wherein the heavy hydrocarbon oil feedstock is a crude oil or a distillation residuum of crude oil.

3. A process in accordance with claim 1 wherein the particulate coal has a particle size in the range between about 20–2000 microns.

4. A process in accordance with claim 1 wherein the particulate coal is bituminous coal.

5. A process in accordance with claim 1 wherein the weight ratio of heavy hydrocarbon oil to coal in the step (1) admixture is in the range between about 1.5–20:1.

6. A process in accordance with claim 1 wherein the step (1) heat treatment is conducted at a temperature between about 800°–950° F. and a pressure between about 0–2000 psi, and at a weight hourly space velocity between about 0.1–100.

7. A process in accordance with claim 1 wherein the step (1) heat treatment is conducted in the presence of a hydrogen partial pressure between about 50–2000 psi to increase demetallation of the feedstock and to suppress formation of coke.

8. A process in accordance with claim 1 wherein the step (1) heat treatment is conducted in the presence of an inert gas to improve control of flow dynamics.

9. A process in accordance with claim 8 wherein the inert gas is steam or a light hydrocarbon.

10. A process in accordance with claim 1 wherein the step (2) settling zone is maintained at a temperature between about 450°–650° F. and a pressure between about 0–2000 psi for a period between about 0.1–5 hours.

11. A process in accordance with claim 1 wherein the step (2) settling of asphaltene flocculated fine solids is promoted by the addition of a deasphalting solvent.

12. A process in accordance with claim 11 wherein the deasphalting solvent is liquid hydrocarbon containing between about 3–12 carbon atoms.

13. A process in accordance with claim 1 wherein the oil fraction recovered in step (3) is charged to a hydrotreating zone for production of low sulfur distillates.

14. A process in accordance with claim 1 wherein the oil fraction recovered in step (3) is subjected to distillation to provide gas oil distillate and tar bottoms.

15. A process in accordance with claim 1 wherein at least a portion of the solids fraction recovered in step (3) is recycled to the step (1) visbreaking zone.

16. A process in accordance with claim 1 wherein at least a portion of the solids fraction recovered in step (3) is combusted as solid fuel, and the metals content of the resultant ash is recovered.

* * * * *

UNITED STATES PATENT AND TRADEMARK OFFICE

CERTIFICATE OF CORRECTION

PATENT NO. : 4,334,976

DATED : June 15, 1982

INVENTOR(S) : Tsoung Y. YAN

It is certified that error appears in the above—identified patent and that said Letters Patent is hereby corrected as shown below:

Column 9, line 10, change "Residue, Wt.% 11" to ---Residue, Wt.% 100---

Signed and Sealed this

*Twenty-third* Day of *November 1982*

[SEAL]

*Attest:*

GERALD J. MOSSINGHOFF

*Attesting Officer*

*Commissioner of Patents and Trademarks*